US006269750B1

(12) United States Patent
Cornwell et al.

(10) Patent No.: US 6,269,750 B1
(45) Date of Patent: Aug. 7, 2001

(54) TRUSS TRACK ASSEMBLY AND SIDE MOUNT ROLLER COASTER VEHICLE

(75) Inventors: Joseph M. Cornwell; Joseph E. VanDenBerghe, both of Ogden; Steven E. Nuetzman, West Point; Carl G. Wood, South Ogden; Benjamin H. Womack, Huntsville; Reid H. Leland, Bountiful; Bret Crandall, Mapleton, all of UT (US)

(73) Assignee: Setpoint Engineered Systems, Inc., Ogden, UT (US)

( * ) Notice: Subject to any disclaimer, the term of this patent is extended or adjusted under 35 U.S.C. 154(b) by 0 days.

(21) Appl. No.: 09/535,285

(22) Filed: Mar. 24, 2000

Related U.S. Application Data

(62) Division of application No. 09/105,935, filed on Jun. 26, 1998, now Pat. No. 6,047,645.

(51) Int. Cl.[7] ..... A63G 7/00

(52) U.S. Cl. ..... 104/53; 104/55; 104/56; 104/63; 104/124; 104/125

(58) Field of Search ..... 104/53, 55, 56, 104/63, 288, 124, 125, 64, 65

(56) References Cited

U.S. PATENT DOCUMENTS 4,226,187 * 10/1980 Paulsen et al. ..... 104/182
5,272,984 * 12/1993 Bolliger et al. ..... 104/63
5,595,121 * 1/1997 Elliott et al. ..... 104/53
5,685,227 * 11/1997 Gaccetta ..... 105/150
5,979,333 * 11/1999 Houben et al. ..... 104/63
6,098,549 * 8/2000 Mares ..... 104/76

* cited by examiner

*Primary Examiner*—S. Joseph Morano
*Assistant Examiner*—Frantz F. Jules
(74) *Attorney, Agent, or Firm*—Madson & Metcalf

(57) ABSTRACT

A novel truss track assembly for use in transporting passenger vehicles provides two sets of tracks for supporting two passenger vehicles concurrently. The truss track assembly includes four running rails for mounting passenger vehicles and a central support rail. A series of frame elements are periodically secured to the running rails and the central support rail to support and maintain the parallel relationship of the running rails and the central support rail. The truss track assembly may be "split" into two individual truss track assemblies wherein the individual truss track assemblies each accommodate a passenger vehicle or a train of passenger vehicles. The present invention further provides a novel side-mount vehicle suitable for mounting of the present invention on the truss track assembly. The side-mount vehicle improves sight line feature by locating the passengers off to the side of the track; rather than locating them above the track as with conventional designs, or below the track as with suspended designs. A side-mount passenger vehicle travels along a pair of parallel rails fixed in space. The rails of the present invention remain oriented in an essentially vertical plane with respect to a seated passenger, as opposed to the horizontal orientation associated with more conventional roller coaster rides. Seats are positioned on a cantilevered beam which is affixed at one end to a main chassis beam. The main chassis beam is secured to the parallel rails through two sets of wheel assemblages. The side-mount feature of the present invention enhances and intensifies passenger thrill and excitement because of substantially unrestricted passenger view in all directions, resulting in a "free flying" experience.

17 Claims, 13 Drawing Sheets

TRUSS TRACK ASSEMBLY AND SIDE MOUNT ROLLER COASTER VEHICLE

RELATED APPLICATIONS

This application is a divisional of U.S. patent application Ser. No. 09/105,935, filed Jun. 26, 1998, now U.S. Pat. No. 6,047,645.

THE FIELD OF THE INVENTION

The present invention relates to amusement ride systems, and in particular, amusement ride systems of the roller coaster type. More specifically, the present invention relates to a truss track assembly for use in transporting side-mount passenger vehicles.

THE BACKGROUND ART

Amusement rides of the roller coaster type have enjoyed immense popularity in the United States and elsewhere for over one hundred years. As is custom, these rides often consist of a passenger carrying vehicle, or collection of vehicles joined together, which traverse along a track system. Historically, the track system typically comprised a pair of parallel rails which exhibit steep upward and downward gradients in elevation, and sharp left and right banking turns. Aside from supplying the passenger with a pleasing panoramic view from high elevations, the main objective of the roller coaster ride was to thrill the passenger by traversing the track at the fastest possible speed while maintaining an acceptable degree of safety. The thrill experienced by the passenger thus arose through the sensations of rapid acceleration, brought about through rapid changes in vertical and horizontal direction of movement.

Innovations in roller coaster design sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride. As a result, other innovations sought to enhance and intensify passenger thrill by incorporating increasingly complex geometries into the track system itself. Two of the more common track geometries which have thus evolved are the loop and the helix.

Typical prior art disclosures of a track system employing a loop may be found in U.S. Pat. No. 609,164 (Prescott 1898); U.S. Pat. No. 812,595 (Roberts 1906); U.S. Pat. No. 1,441,404 (Czerny 1923); U.S. Pat. No. 2,567,438 (McBride 1951); U.S. Pat. No. 3,411,783 (Montagna 1968); and U.S. Pat. No. 5,463,962 (Gnezdilov 1995). In these systems, a vertical loop geometry is often positioned somewhere in the middle of the amusement ride. As the passenger vehicle traverses the loop it makes a somersault, giving passengers a thrill similar to that which one might experience during a loop-the-loop maneuver performed by an aerial acrobatic airplane.

Typical prior art disclosures of a track system employing a helix may be found in U.S. Pat. No. 3,889,605 (Bacon 1975); U.S. Pat. No. 4,724,771 (Yamada 1988); and U.S. Pat. No. 5,433,153 (Yamada 1995). In these systems, a substantially horizontal helix configuration is positioned at some point within the amusement ride. As the passenger vehicle traverses the helix it is rotated in accordance with the twist of the tracks which define the helix. Accordingly, passengers experience a thrill similar to that which one might experience during a barrel-loop maneuver performed by an aerial acrobatic airplane.

Roller coaster designs are often limited by the rigidity, stress resistance, fatigue levels, and flexibility of the track and support structure. Thus, as improvements in materials and technology are increased, more sophisticated and innovative designs are possible. A further consideration in the design of roller coasters is the amount of space required because of the limitations of park space. Furthermore, installation, design, and fabrication costs must also be considered in the creation of a roller coaster.

In parallel with the aforedescribed track system geometries, there also exist innovations in passenger vehicle configurations for enhancing and intensifying passenger thrill. These innovations typically depart from the conventional roller coaster in that the passenger vehicle no longer assumes the standard railway car configuration. For example, Achrekar (U.S. Pat. No. 4,170,943) discloses a suspended passenger vehicle configuration whereby individual passenger units are rotated and translated in a multiplanar manner as the carriage assembly proceeds along a mobious strip, or one-half section of helical track. A more recent departure from the conventional passenger vehicle configuration is disclosed in Bolliger et al. (U.S. Pat. No. 5,272,984). The invention disclosed in Bolliger enables passengers to be suspended from a bogie moving along a horizontal track system, so that a seated passenger's head is in closer proximity to the bogie—and hence the track rails—than are the passenger's body and limbs. This configuration results in a passenger vehicle being designed so that each passenger is suspended with his legs in mid-air without a wall or a floor around him.

Prior art roller coaster designs, including those employing the aforementioned conventional and suspended passenger vehicles, place passengers either above or below the ride track, thus limiting a passenger's forward, above, and below track sight lines. This limitation precludes enhancements to a passenger's thrill level that can otherwise be obtained through use of the side-mount roller coaster vehicle disclosed herein. For example, a conventional roller coaster vehicle—such as that disclosed by Bacon (U.S. Pat. No. 3,889,605)—is configured to travel along a pair of parallel rails that are oriented horizontally with respect to a seated passenger and are positioned below the passenger's feet, that is, the rails lay directly underneath the roller coaster vehicle. Thus, while the passenger has an unobstructed view above and to his or her side, the location of the track assembly as well as the vehicle itself, relative to a seated passenger, preclude unobstructed view of the ground below. Likewise, a suspended roller coaster vehicle—such as that disclosed by Bolliger et al. (U.S. Pat. No. 5,272,984)—is configured to travel along a pair of parallel rails that are oriented horizontally with respect to a seated passenger and are positioned above the passenger's head, that is, the rails lay directly overhead the roller coaster vehicle. Thus, while the passenger has an unobstructed view below and to his or her side, the location and horizontal geometry of the track assembly as well as the vehicle itself, relative to a seated passenger, precludes unobstructed view of the sky above.

The present invention seeks to overcome the aforementioned sight obstructions by positioning the passenger off to the side of the track assembly, thereby affording the passenger an unobstructed view both above and below and to the outboard side of the track. Furthermore, by positioning the passenger's head sufficiently high above the track, an unobstructed side view toward the inboard side of the track can be obtained as well. Still further, the positioning of the passenger seating means on a cantilevered beam, in lieu of being surrounded by a vehicle body, serves well to improve forward passenger sight lines. One result of the side-mounting feature is thus to improve the overall quality of unobstructed passenger sight lines over that available with prior art configurations. A series of vehicles of the present invention may be linked together to form a roller coaster train similar to methods known in the art.

The side-mount vehicle configuration is mountable on either single or dual track configurations (i.e., a pair of vehicles, one left and one right side-mount, running on adjacent rails in the same direction). This ability to configure the side-mount vehicles in both single train and dual train modes also enables the track system to assume further modifications over conventional track elements. For example, along with the more conventional banked turns, loops, and helixes, the side-mount feature enables a dual train configuration to split into two single-train configurations, each then traversing separate segments of track. At a later point, the two single-train configurations can either rejoin into a dual train configuration, or speed past one another in opposing directions. Incorporating the aforementioned "on-the-fly" changing of configurations into the conventional ride elements adds again to the enhanced passenger thrill resulting from the side-mount vehicle system.

An additional feature of side-mount vehicles is that they tend to be shorter than conventional vehicles. Accordingly, roller coaster trains comprising side-mount vehicles tend to be shorter than conventional trains. This allows the trains to transition quicker than do conventional trains.

The present invention further seeks to provide truss tracks which require less structure.

Less structure allows for tracks which can serpentine around with minimal clearance envelope problems, while at the same time, requiring less steel and concrete in its construction when compared with more conventional configurations. A further advantage of the shorter trains and reduced structural support is the ability to fit the maximum amount of ride experience into a minimum acreage footprint.

In view of the aforesaid, an object of the present invention is to provide a unique and enhanced passenger experience through use of a side-mount passenger vehicle design. The side-mount vehicle design effectively combines the advantages and thrills of both conventional and suspended roller coasters into one ride. Improved forward, above, side-to-side, and below track sight lines offer passengers a unique "free flying" ride experience which enhances and intensifies passenger thrills and increases the anticipation of upcoming ride elements (i.e., loops, turns, etc.). In addition, the side-mount feature enables new track elements—i.e., track splits and merges—to be incorporated into the overall ride layout. Still further, the shorter vehicle size associated with the side-mounting feature of the present invention, coupled with less required structure, permits tighter transitions to be configured into the overall track layout, resulting in more ride per unit of acreage footprint. This in turn enhances passenger thrill by imposing on the passenger faster variations in acceleration forces due to more rapid changes in direction.

Thus, it would be an advancement in the art to provide a track structure with increased rigidity, stress resistance, fatigue levels, and layout flexibility to allow superior safety and increased innovation in track designs.

It would be a further advancement in the art to provide a track structure requiring less support structure.

It would be another advancement in the art to provide a roller coaster with passenger vehicles which offer an improved line of sight and provide a new ride experience.

Such apparatuses are disclosed and claimed herein.

BRIEF SUMMARY

The present invention provides a novel truss track assembly for use in transporting passenger vehicles. The truss track assembly comprises four parallel running rails which provide two sets of tracks for supporting two passenger vehicles concurrently. The truss track assembly further comprises transverse frame elements which are secured substantially perpendicular between the first set of running rails and between the second set of running rails. The truss track assembly also comprises lateral frame elements which are secured between parallel transverse frame elements to thereby join a pair of transverse frame elements. A central rail runs parallel to the running rails and is disposed within a rectangular area defined by the running rails. A plurality of angled frame elements are secured to the transverse frame elements and the central rail to secure the position of the central rail relative to the four running rails. The truss track assembly may be "split" into two individual truss track assemblies wherein the individual truss track assemblies accommodate a single passenger vehicle or train each.

The design of the truss track assembly results in high rigidity, more stress resistance, higher layout flexibility, and less support structure. Because of the higher layout flexibility and less support structure, the truss track assembly requires less horizontal space to provide more ride per unit of acreage footprint. Less structure provides more flexibility in track layout designs or in the placement of buildings, walkways, or other adjacent structures, landscaping, etc. Moreover, because of the straightforward fabrication the design and fabrication costs are reduced.

The present invention further provides a novel side-mount vehicle suitable for mounting on the aforementioned truss track assembly. The side-mount vehicle enhances and intensifies passenger thrill by improving forward, above, and below track passenger sight lines, resulting in a unique "free flying" experience. This improved sight line feature results from locating the passengers off to the side of the track; rather than locating them above the track as with conventional designs, or below the track as with suspended designs.

To facilitate location of the passengers off to the side of the track, the first and second rails of the present invention lay in a plane that is essentially vertical with respect to a seated passenger, as opposed to the horizontal plane assumed by conventional and suspended roller coaster systems. A vertical main chassis beam is movably secured to the rails through two sets of wheel assemblages. Each wheel assemblage set includes three pair of wheels: an outer pair of spring loaded side-guide wheels, an inner pair of spring loaded side-guide wheels, and a vertically oriented pair of spring loaded up-stop/down-stop wheels. Each of the resulting six pair of wheels is further disposed so as to be aligned with the longitudinal direction of the rail. This aforedescribed mounting of the vertical chassis to the rails enables the vehicle to traverse an arbitrarily complex serpentine path comprising loops, helixes, and sharp banks, etc., or any combination of these and other conventional track elements.

Secured to the vertical main chassis beam is a cantilevered seat beam. One end of the cantilevered seat beam is rigidly attached to the vertical main chassis beam through welding or bolting. The cantilevered seat beam could be located near the top of the vertical main chassis beam, in a horizontal fashion, resulting in somewhat of an upside down "L" configuration. This configuration leads to much improved sight lines when compared with those disclosed in the prior art. However, the cantilevered beam could also be located near the bottom of the main chassis beam, or somewhere in the middle, depending on the desired application. The passenger seats and their associated restraining devices are then positioned on and secured to the cantilevered beam. Location of the cantilevered seat beam in this fashion, with the passenger seats secured thereto, affords passengers greater unobstructed forward, above, side-to-side, and below sight lines. A further advantage is that the side-mount vehicle will be shorter which provides tighter track transitions than with conventional vehicles.

Thus, it is an object of the invention to provide a truss track assembly having greater rigidity, greater track layout flexibility, more stress resistance, and requiring less support structure to accommodate innovative track designs.

It is another object of the invention to provide a truss track assembly which reduces fabrication costs.

It is still another object of the invention to provide passenger vehicles which allow greater unobstructed views and enhance the ride experience.

These and additional objects and advantages of the present invention will be apparent in the following description.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
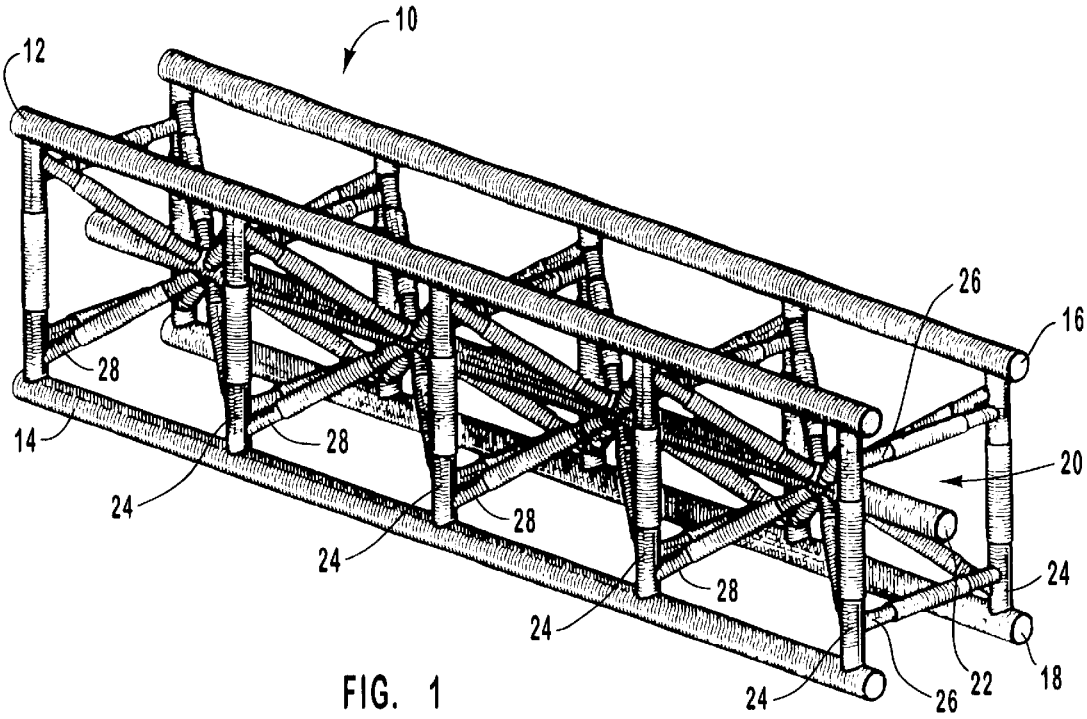
FIG. 1 is a perspective view of one presently preferred embodiment for the dual truss track assembly of the present invention.
Figure 2:
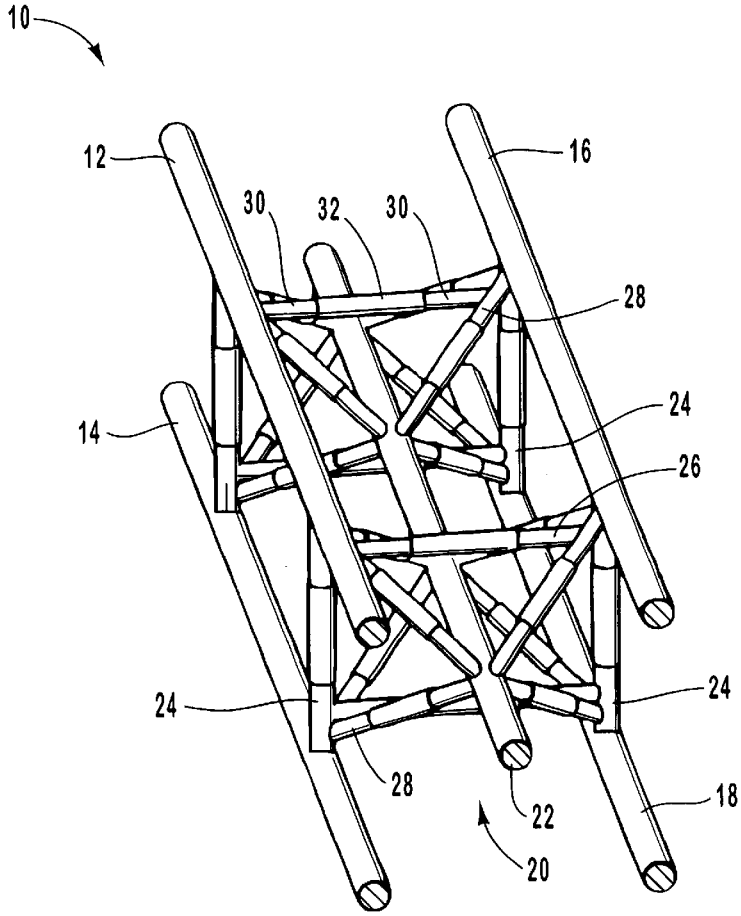
FIG. 2 is an alternative perspective view of the embodiment of FIG. 1.

Reference is now made to the embodiments of the truss track assemblies and side-mount vehicles illustrated in FIGS. 1 through 16. With reference to FIGS. 1 and 2, one presently preferred embodiment for a track assembly is shown and generally designated as 10. The track assembly 10 is formed as an open framework and comprises four running rails 12, 14, 16, 18 which form two sets of longitudinally running parallel rails as shown in FIGS. 1 and 2. The running rails 12, 14, 16, 18 are supported by a truss assembly 20 comprising a longitudinal central rail 22. The longitudinal central rail 22 runs parallel with the running rails 12, 14, 16, 18.

The truss assembly 20 further comprises periodically positioned transverse frame elements 24 which are disposed to join rail 12 with rail 14 and rail 16 with rail 18, respectively. In one presently preferred embodiment, each transverse frame element 24 joining rails 12, 14 is disposed in parallel with a transverse frame element 24 joining rails 16, 18.

The truss assembly 20 further comprises lateral frame elements 26 which extend laterally between each pair of parallel transverse frame elements 24. The lateral frame elements 26 are secured at both ends to the transverse frame elements 24. In one presently preferred embodiment, two lateral frame elements 26 are secured to a pair of parallel transverse frame elements 24 at opposing sides of the central rail 22 as shown in FIGS. 1, 2. In an alternative embodiment, the lateral frame elements 26 extend laterally and are secured to running rails 12 and 16, and running rails 14, 18. In the alternative embodiment, the lateral frame elements 24 are preferably secured to the running rails 12, 14, 16, 18 at the approximate longitudinal position of securement of the transverse frame elements 26.

The truss assembly further comprises angled frame elements 28 disposed to secure the central rail 22 to a parallel pair of transverse frame elements 24. The angled frame elements 28 are preferably secured to the transverse frame elements 24 proximate to the ends of the transverse frame elements 24.

In one presently preferred embodiment, eight angled frame elements 28 extend from each pair of parallel transverse frame elements 24 as shown in FIGS. 1 and 2. Two angled frame elements 28 extend proximate from each end of each transverse frame element 24. As shown in FIGS. 1 and 2, four angled frame elements 28 extend forward and four angled frame elements 28 extend rearward from the longitudinal position of the parallel pair of transverse frame elements 24. The four forward oriented angled frame elements 28 are secured to the central rail 22 at the approximately same longitudinal position. Similarly, the four rearward oriented angled frame elements 28 are secured to the central rail 22 at the approximately same longitudinal position.

The running rails 12, 14, 16, 18 provide two sets of tracks to which a vehicle may be mounted. For orientation purposes, running rails 12, 16 are considered to be vertically above running rails 14 and 18. A vehicle may ride above the track on running rails 12, 16, below the track on running rails 14, 18, or on the side on running rails 12, 14 or 16, 18. Side-mount vehicles suitable for use on the track assembly 10 are disclosed in detail below. Furthermore, because the track assembly 10 provides two sets of tracks, two vehicles may be operated concurrently on the same track assembly. Thus, two vehicles may be mounted above and below the track assembly 10 or two vehicles may be side-mounted to the track assembly to allow dual use. Accordingly, for designation the track assembly 10 will be referenced hereinafter as a dual track assembly. Vehicles may proceed in the same direction for racing configurations or in opposing directions along the dual track assembly 10.

A further feature of the dual track assembly 10 is that of adjusting the length during installation in the transverse frame elements 24, the lateral frame elements 26, and the angled frame elements 28. In one presently preferred embodiment, the frame elements 24, 26, 28 each comprise two end members 30 and a telescoping member 32. The telescoping member 32 is cylindrical having a hollow interior and is sized to accommodate and receive both end members 30 such that a portion of the end members 30 extend into the telescoping member 32. The end members 30 are slidably movable within the telescoping member 32 to thereby allow adjustment of the length of the frame elements 24, 26, 28. Once an appropriate length is determined, the end members 30 and the telescoping member 32 may be bonded together by means such as welding. The ends of the end members 30 extending from the telescoping member 32 may be preconfigured enmasse to better fit to the contour of a receiving surface. The advantage to these described features is to allow bulk manufacture of the components of the frame elements 24, 26, 28 prior to track fabrication and fit up. This substantially reduces time and labor in individually cutting and sizing each frame element 24, 26, 28 at the site.

Figure 3:
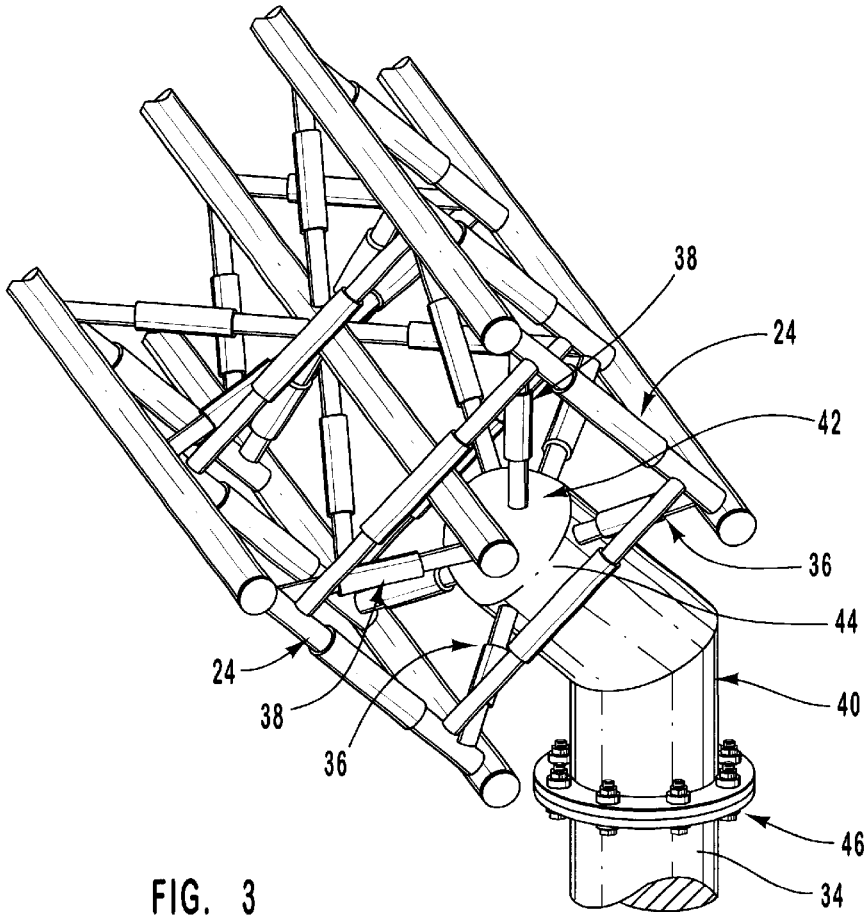
FIG. 3 is a perspective view of the dual truss track assembly of FIG. 1 attached to a support beam.

With reference to FIG. 3, the dual track assembly 10 is preferably mounted on a rigid surface, such as the ground, by support columns 34 positioned along the length of the track assembly 10 in accordance with local load requirements. The dual track assembly 10 may be secured to the support column 34 through an assemblage of horizontal support frame elements 36 and angled support frame elements 38. The dual track assembly 10 may be used with support columns 34 comprising column saddles 40 having caps 42 as shown in FIG. 3. Such support columns 34 are well known in the art. The angled support frame elements 38 are disposed and secured between the transverse frame elements 24 and the cap 42 of the column saddle 40. Similarly, the horizontal support frame elements 36 are positioned and secured between the transverse frame elements 24 and the base portion 44 of the column saddle 40. Column saddle 40 may be fastened to column post 34 by a bolting interface 46 or some other suitable means of attachment, or may simply be integral to the support column 34.

Although FIG. 3 shows the column saddle 40 disposed at a specific angle with respect to the support column 34, it is noted here that any angle necessary to accommodate the local track configuration may be employed. This mounting feature facilitates the variety of loops and twists that may be incorporated into the overall track layout.

The horizontal support frame elements 36 and the angled support frame elements 38 may also be configured as frame elements 24, 26, 28 to permit length adjustment during fabrication. Thus, horizontal support frame elements 36 and the angled support frame elements 38 comprise end members 30 and a telescoping member 32. Interaction of the end members 30 and the telescoping members 32 is as previously explained.

A novel feature of the dual track assembly 10 is that the running rails 12, 14, 16, 18 upon which the vehicles are mounted are actually part of the truss assembly structure. This design of the dual track assembly 10 results in high stiffness, low stresses and straightforward fabrication. Accordingly, the configuration of the dual track assembly 10 is less costly, more rigid, and more resistant to fatigue. Design and fabrication costs are reduced due to standardization of track components and the adjustability of the frame elements 24, 26, 28. Due to the high rigidity and stiffness of the dual track assembly 10, far less support structure and fewer inches of weld per foot of track are required than with conventional track designs. Thus, the dual track assembly 10 may span greater distances than conventional track. Installation costs are lower because less steel and less concrete are required. Less structure also provides more flexibility in track layout designs or in the placement of buildings, walkways, or other adjacent structures, landscaping, etc.

Figure 4:
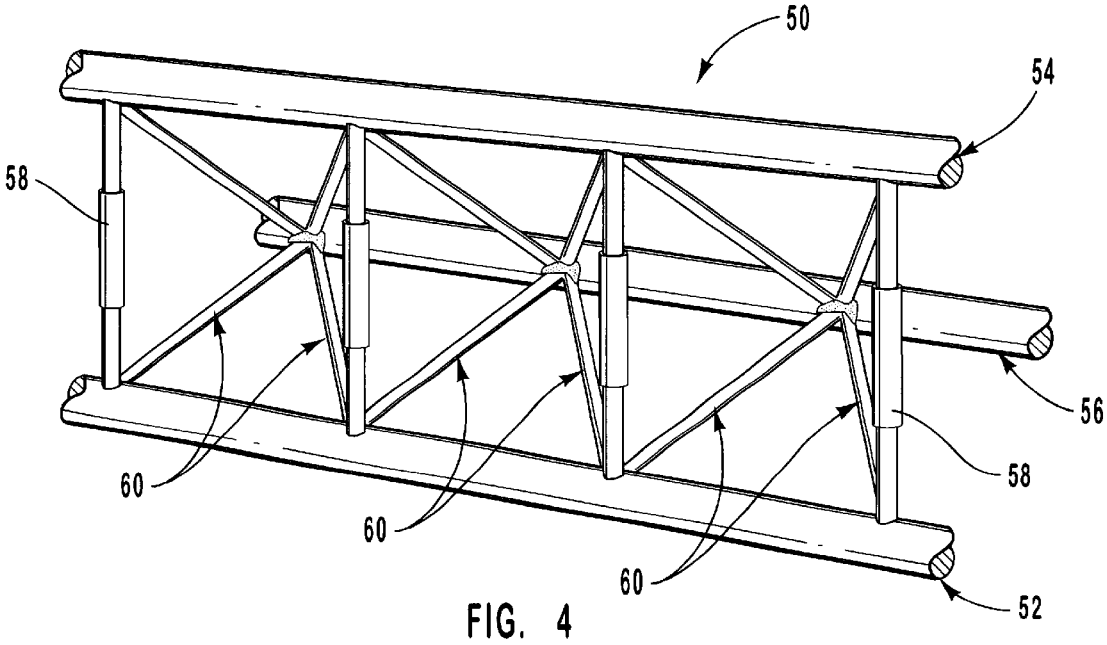
FIG. 4 is a perspective view of an embodiment of a single truss track assembly.

With reference to FIG. 4, another track assembly is shown and is generally designated as 50. The track assembly 50 accommodates one side-mount vehicle on but one side of the track. Accordingly, the track assembly 50 shall be referred to herein as a single track assembly.

The single track assembly 50 differs from track assembly 10 in that it provides two parallel running rails 52, 54. The single track assembly 50 comprises an open framework having a single support rail 56 that runs longitudinally parallel with rails 52, 54, and supports the parallel rails 52, 54 in a fashion similar to the center rail 22.

The two parallel rails 52, 54 are secured to one another by periodically positioned transverse frame elements 58. Angled frame elements 60 are secured to the support rail 56 and the transverse frame elements 58. Preferably, the angled frame elements 60 are secured to the transverse frame elements 58 proximate to the ends of the transverse frame elements 58.

In one presently preferred embodiment, four angled frame elements 60 extend from each transverse frame element 58 with two angled frame elements 60 extending proximate from each end of the transverse frame element 58. Two angled frame elements 60 extend forward along the longitudinal axis and two angled frame elements 60 extend rearward along the longitudinal axis from the longitudinal position of the corresponding transverse frame element 58. The forward oriented angled frame elements 60 are secured to the support rail 56 proximate to one another. Similarly, the rearward oriented angled frame elements 60 are secured to the support rail 56 proximate to one another. The transverse frame elements 58 and the angled support frame elements 60 may also be configured to permit length adjustment during fabrication as has been previously explained with frame elements 24, 26, 28.

As with the track assembly 10, the single track assembly 50 is preferably mounted on conventional support columns which are in turn secured to a rigid surface, such as the ground. The support columns may be secured to the support rail 56 and positioned along the length of the single track assembly 50 in accordance with track load requirements. Specific means for securing the single track assembly 50 to the support columns may be based on the means used to secure the track assembly 10 to support column 30 as shown in FIG. 3. Alternative conventional methods for securing the support rail 56 to support columns are well known in the art. For example, support columns may be directly attached to the support rail 56 by welding or bolting.

Figure 5:
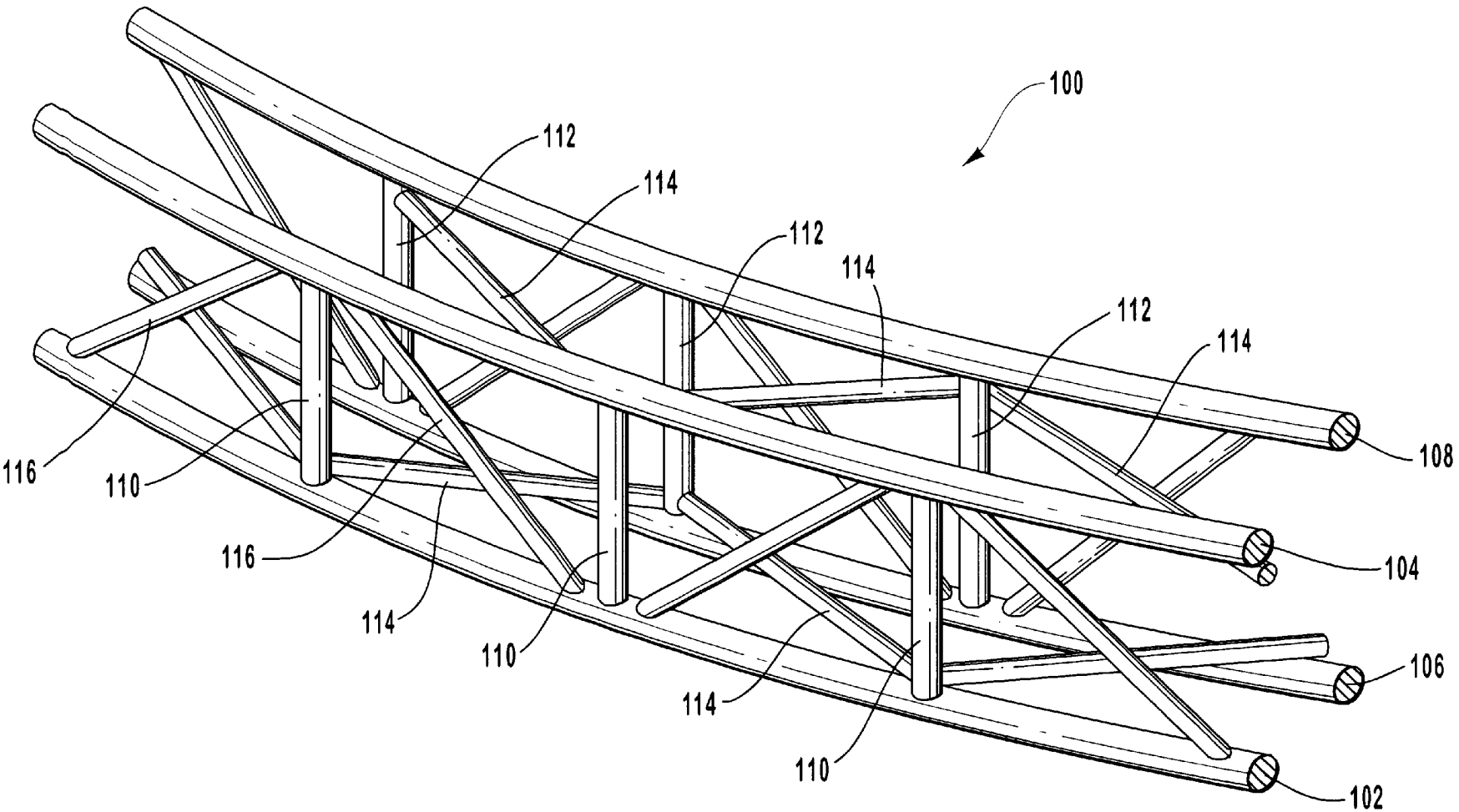
FIG. 5 is a perspective view of an alternative embodiment of a single truss track assembly.

With reference to FIG. 5, an alternative embodiment for a single track assembly is shown and generally designated 100. The single track assembly 100 comprises two parallel running rails 102, 104. Rather than a single support rail, the single track assembly 100 comprises a pair of support rails 106, 108, which run parallel with the two running rails 102, 104. As with the embodiment of FIG. 4, the two running rails 102, 104 are secured to one another by periodically positioned transverse frame elements 110. Similarly, the two support rails 106, 108 are secured to one another by periodically positioned transverse frame elements 112.

The single track assembly 100 further comprises cross frame elements 114 which are secured in an angular fashion to the transverse frame elements 110, 112. The cross frame elements 114 function to secure the position of the running rails 102, 104 and the support rails 106, 108 relative to one another. The transverse frame elements 110, 112 are preferably positioned across from one another so as to enable the cross frame elements 114 to be positioned between and secured to transverse frame elements 110, 112 in a staggered manner as shown in FIG. 5. Additional rigidity may be further obtained by incorporating angled frame elements 116 between successive pairs of transverse frame elements 110 and between successive pairs of transverse frame elements 112. The transverse frame elements 110, 112 and the cross frame elements 114 may also be configured to permit length adjustment during fabrication as has been previously explained with frame elements 24, 26, 28.

As with the previous embodiment, the single track assembly 100 is preferably mounted on conventional support columns which are in turn secured to a rigid surface, such as the ground. The support columns are positioned along the length of the track in accordance with track load requirements.

Figure 6:
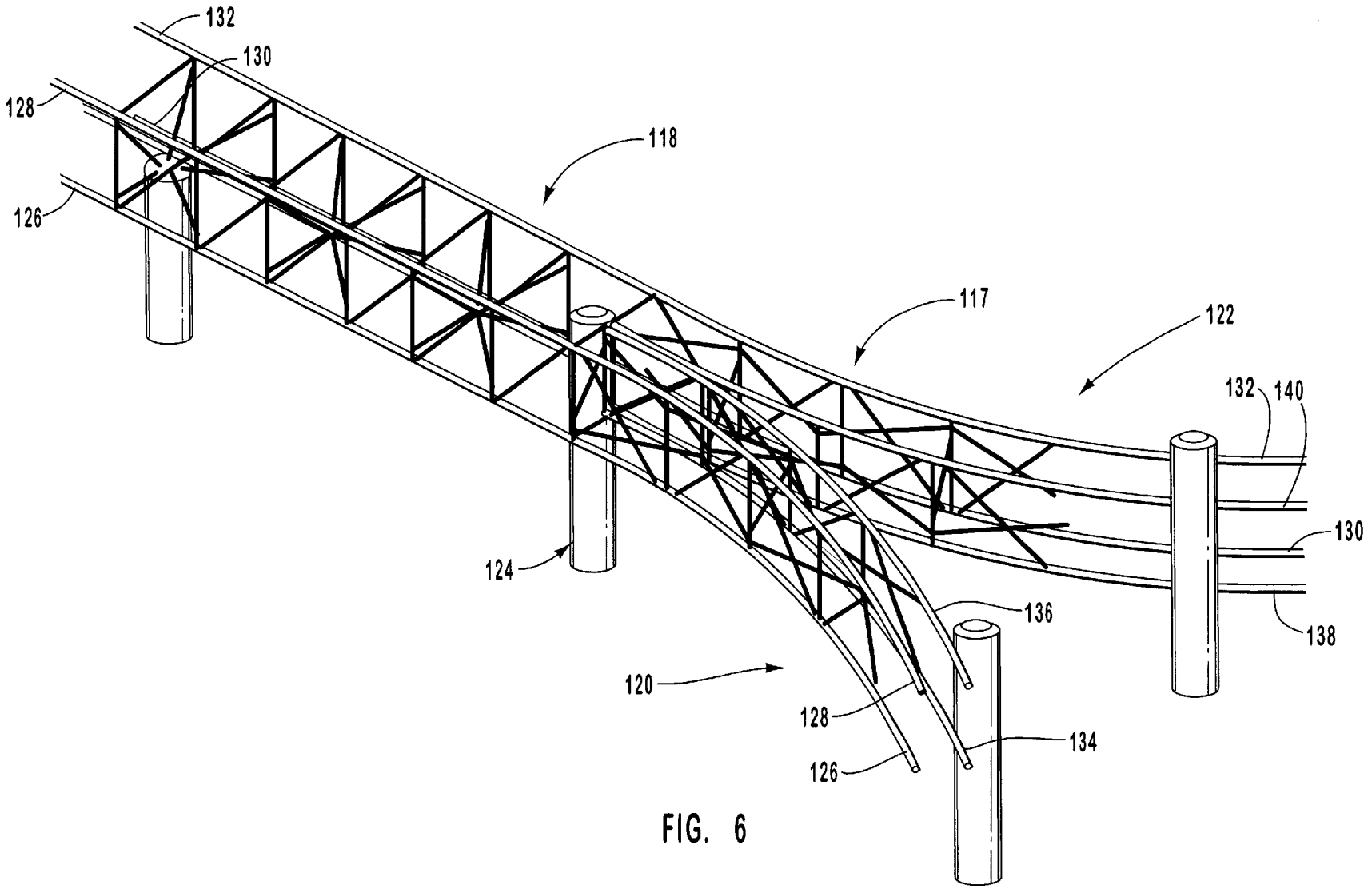
FIG. 6 is a perspective view of a merge/split configuration of the truss track assembly.

With reference to FIG. 6 a track assembly segment termed as a "merge/split track assembly" is shown and generally designated as 117. The merge/split track assembly 117 enables the splitting of the illustrated dual track assembly segment 118 into two independent single track assembly segments 120, 122. The merge/split track assembly 117 shown in FIG. 6 requires that the dual track assembly segment 118 have side-mount vehicles. The single track assemblies 120, 122 are those of the embodiment of FIG. 5. However, it is possible to configure the split feature with the single track assembly embodiment of FIG. 4. It is further possible to later merge the independent single track assemblies 120, 122 back into a dual track assembly 118. The structure of either the split or the merge configuration is generally the same, that is, a split configuration resembles a merge configuration upon reversing the vehicle direction.

As shown in FIG. 6 moving from left to right the track assembly segment 118 terminates at a split support column 124. However, the two sets of longitudinal parallel running rails 126, 128, 130, 132 continue on and become part of the two singular track assembly segments 120, 122, respectively. Support rails 134, 136, 138, 140, begin from attachment points on split column support 124 and extend outwardly in directions parallel to running rails 126, 128, and 130, 132 respectively. From this point on, the two single track assemblies 120, 122 are configured as the embodiment of FIG. 5.

For the merge configuration, the same description can be used, except in a reverse manner, starting from two single track assembly segments 120, 122 and ending with a dual track assembly segment 118.

Popular track designs such as the vertical loop, the helix section, and other conventional roller coaster track designs may be accommodated by the track assemblies of the present invention. Complex track designs may also be accommodated such as shown in FIG. 7 wherein a vehicle is shown as it traverses through a portion of dual track assembly in the shape of a complex figure eight.

Figure 8:
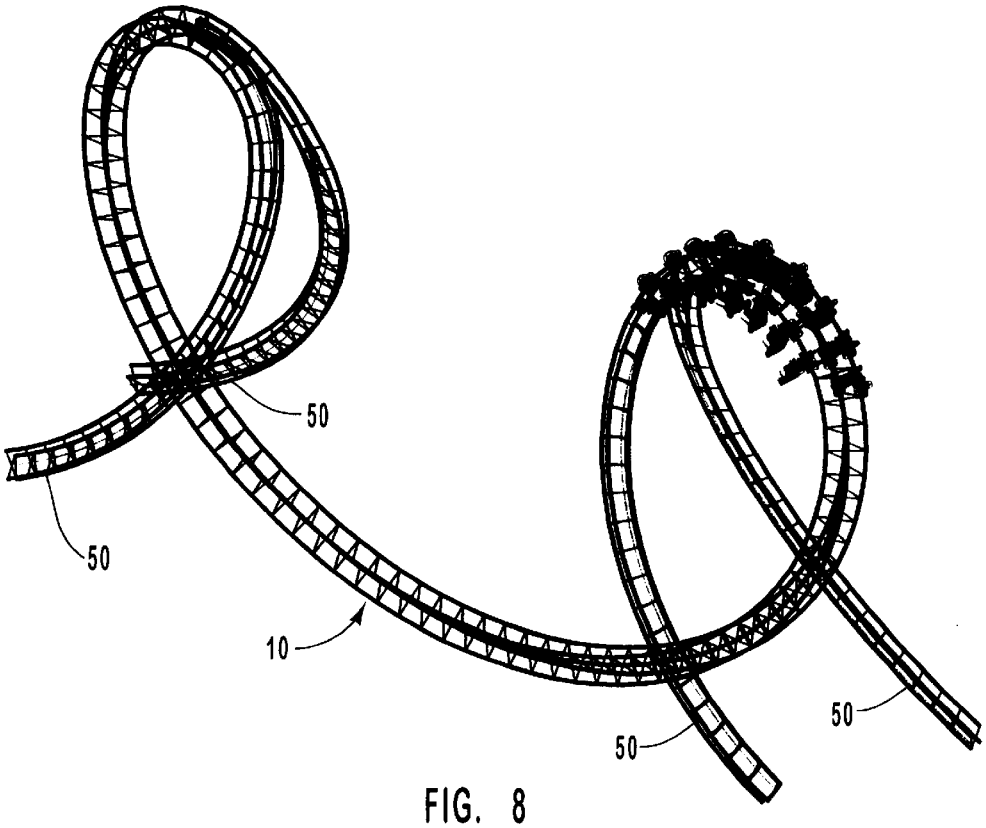
FIG. 8 is a perspective view of two inclined vertical loop incorporating two merge/split configurations.

A combination of the dual track assembly 10, the single track assembly 50, 100, and the merge/split track assembly 117 in a single roller coaster allows for a wide variety of dynamic splitting and merging features to enhance a roller coaster experience. With reference to FIG. 8, going from left to right, a three-dimensional split double loop layout is shown where two single track assemblies 50 approach a vertical loop and merge by means of the merge/split track assembly 117 into a dual track assembly 10 in the racing configuration. The dual track assembly 10 then splits apart by means of another merge/split track assembly 117 onto separate single track assemblies 50 near the peak of the subsequent vertical loop.

Figure 9:
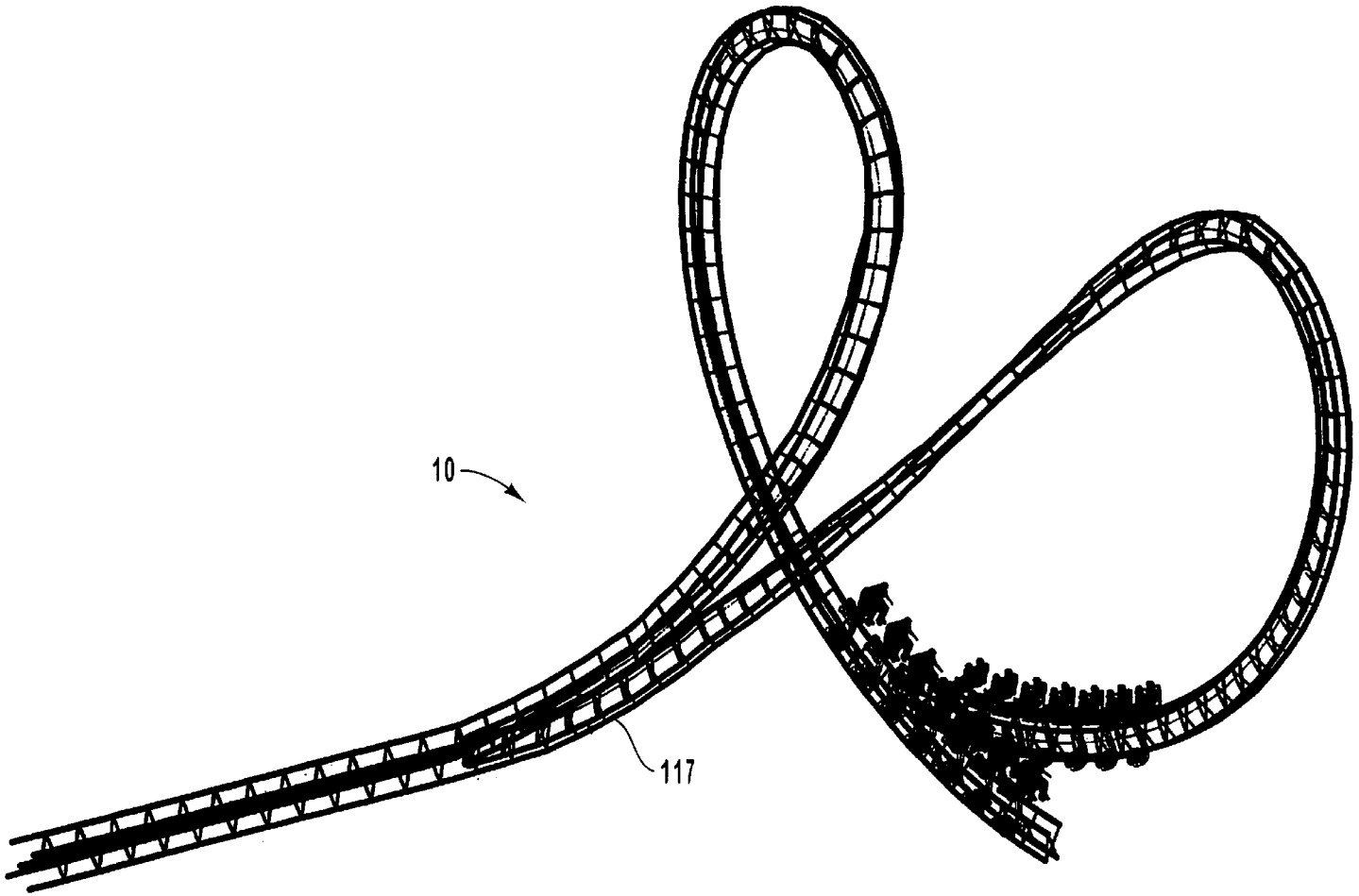
FIG. 9 is a perspective view of another possible track configuration.

With reference to FIG. 9, another innovative design is shown incorporating the merge/split track assembly 117. A head-on collision appears imminent as two vehicles, previously split apart into a pair of single track assemblies 50 approach one another in a near head-on fashion.

Figure 7:
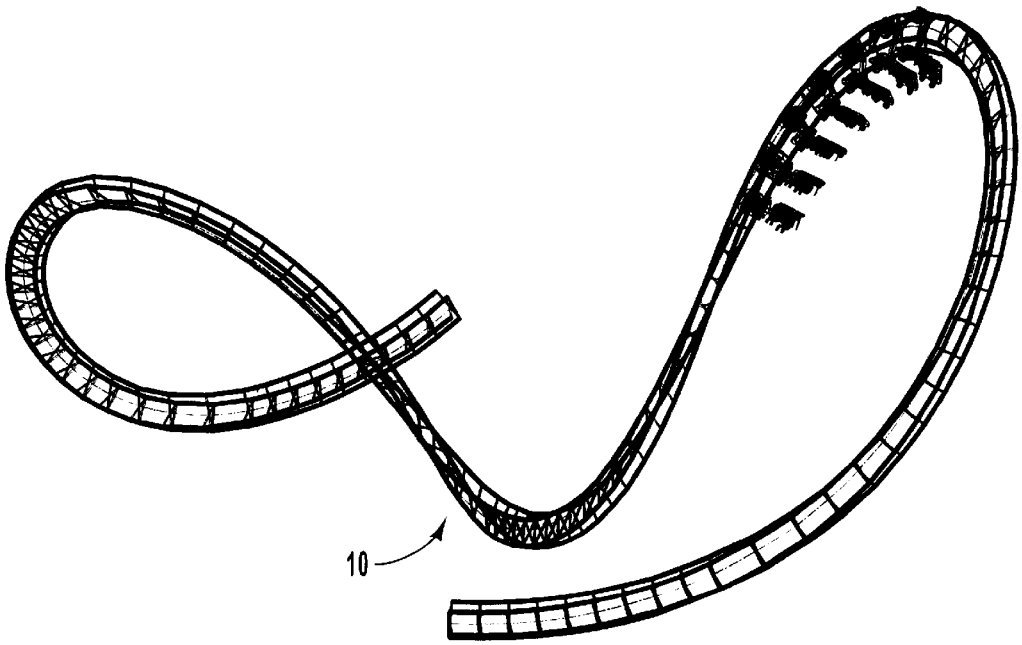
FIG. 7 is a perspective view of one possible track configuration.

FIGS. 7 through 9 generally illustrate the extreme flexibility that may be used while incorporating the dual track assembly 10, single track assembly 50, 100, and merge/split track 117 assembly segments into geometrically complex track shapes.

Figure 10:
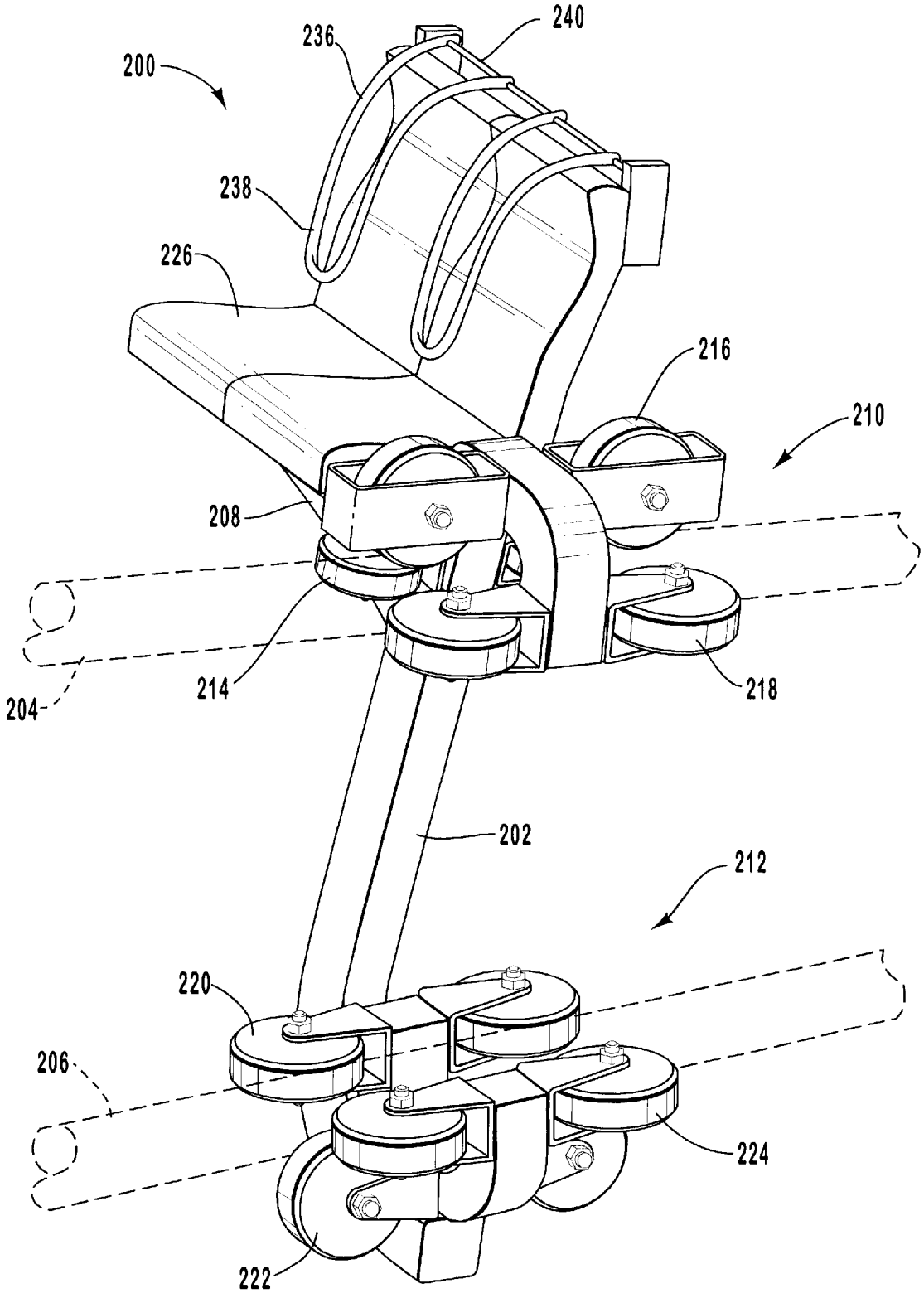
FIG. 10 is a perspective view of one presently preferred embodiment of the side-mount vehicle of the present invention.
Figure 11:
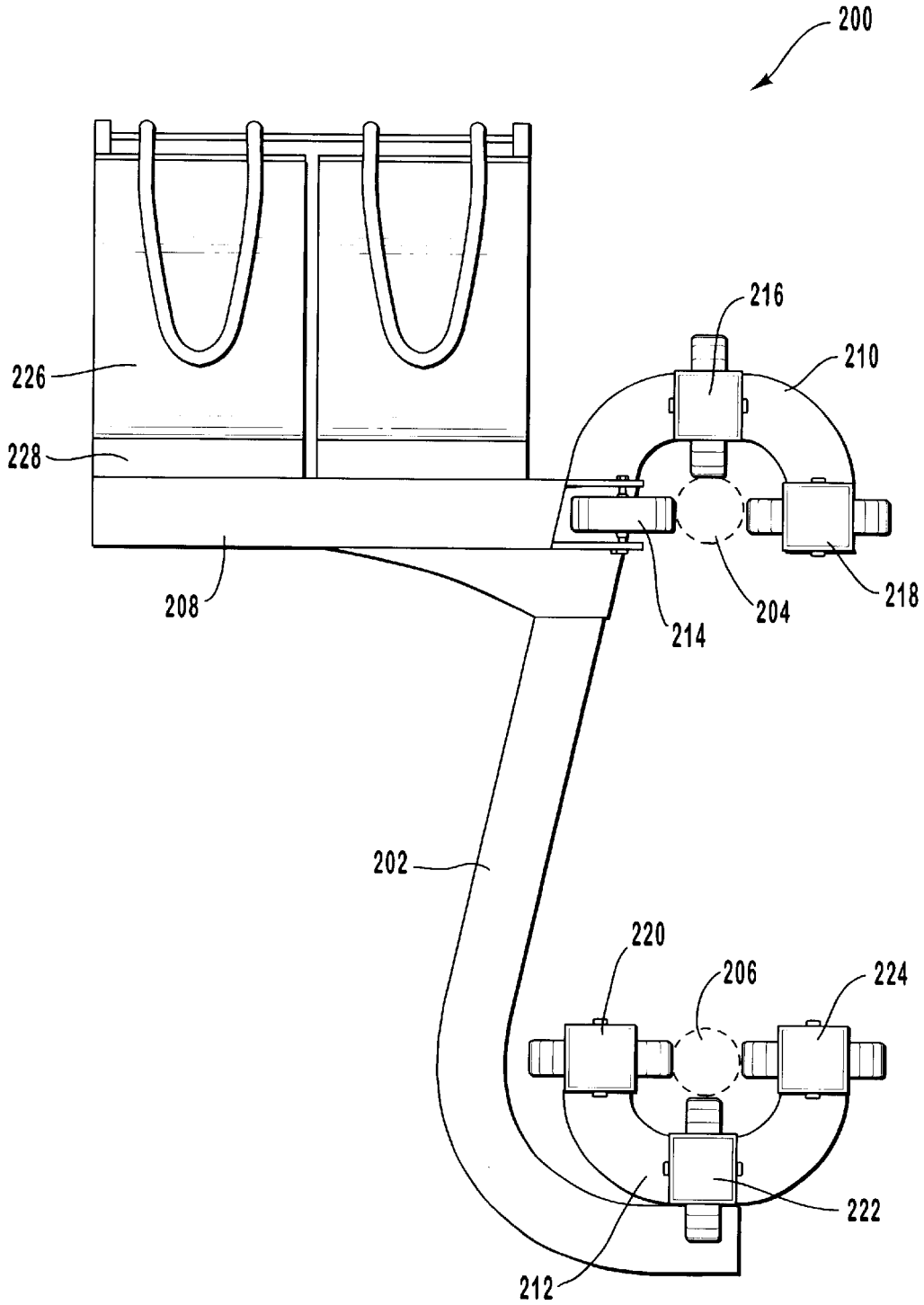
FIG. 11 is a plan view of the embodiment of FIG. 10.

With reference to FIGS. 10 and 11, one presently preferred embodiment for a side-mount vehicle system is shown and is generally designated 200. The side-mount vehicle 200 provides a substantially unrestricted passenger view in various directions and reduces frames of reference normally provided by a track. This provides an enhanced experience as riders cannot always anticipate the path of the track. The side-mount vehicle 200 is suitable for use on the dual track assemblies 10, single track assemblies 50, 100, and the merge/split track assemblies 117 discussed previously above. A series of side-mount vehicles 200 linked together form a roller coaster train. In operation, the side-mount vehicles 200 locates passengers off to the side of the vehicle in a compact manner such that all conventional roller coaster track elements can be maintained.

The side-mount vehicle 200 comprises a vertical main chassis beam 202 which is the main structural member of the side-mount vehicle 200. As shown in FIG. 10, the main chassis beam 202 is disposed in an essentially transverse manner with respect to a longitudinal axis defined by the direction of running rails 204, 206 (shown in phantom). The running rails 204, 206 may be a parallel set of running rails from any of the track embodiments disclosed in this invention.

The side-mount vehicle 200 further comprises a cantilevered seat beam 208 (best seen in FIG. 11) which is attached to vertical main chassis beam 202. The cantilevered seat beam 208 may be attached to the vertical main chassis beam 202 at various locations. As shown in FIGS. 10 and 11, the cantilevered seat beam 208 is attached to an upper portion of the vertical main chassis beam 202. This has the advantage of increased passenger view. Alternatively, the cantilevered seat beam 208 may attached at the mid or lower portions of the vertical main chassis beam 202.

The side-mount vehicle 200 also comprises upper and lower wheel assemblage units 210, 212 which are attached to vertical main chassis beam 202. The two wheel assemblage units 210, 212 are intended to cooperate with two track rails 204, 206, respectively. The upper wheel assemblage unit 210 comprises an outboard pair of spring loaded side-guide wheels 214, a pair of spring loaded down-stop wheels 216, and an inboard pair of spring loaded side-guide wheels 218. Similarly, the lower wheel assemblage unit 212 comprises an outboard pair of spring loaded side-guide wheels 220, a pair of spring loaded up-stop wheels 222, and an inboard pair of spring loaded side-guide wheels 224. The presence and location of these six pair of wheels permit the side-mount vehicle to roll forward or backward along a complex track layout, which may comprise a combination of straight, twisted, and looped sections of track. In addition, the wheel assemblage units 210, 212 permit the side-mount vehicle to traverse track sections in an upside down, right side up or sideways manner, while maintaining complete stability at all times.

The upper section of the main chassis beam 202 can be fashioned so as to bend over and partially around upper running rail 204 such that wheel pairs 214, 216, 218 may be attached in a compact manner. Likewise, the lower section of the main chassis beam 202 may bend under and partially around, as with the upper section, such that wheel pairs 220, 222, 224 may be attached in a compact manner. Alternatively, as shown in FIGS. 10 and 11, the main chassis beam 202 may terminate below the lower rail and have attached thereon the lower wheel assemblage unit 212. These depicted means of attaching the wheel pairs to the main chassis beam 202 are by way of example and one of skill in the art will appreciate that other methods are available and are included within the scope of the invention.

Passengers are seated in seats 226, which are affixed to the cantilevered seat beam 208. The seats 226 are shown to accommodate two riders, but the actual number of seats may be varied as desired and in consideration of structural limitations. Rigid affixation of the seats 226 to the cantilevered seat beam 208 is accomplished through any suitable means, such as welding or bolting of a seat frame to the cantilevered beam 208. Rigidly affixing the seats 226 to the cantilevered beam 208 avoids any pendulum-like movement of the seats 226 with respect to the main chassis beam 202. As further shown in FIG. 11, the bottom portion 228 of the seats 226 may provide the point of attachment to the cantilevered beam 208. Alternative locations for attachment could be the back, vertical portion of the seats 226 as well as other portions of the seats 226.

Figure 12:
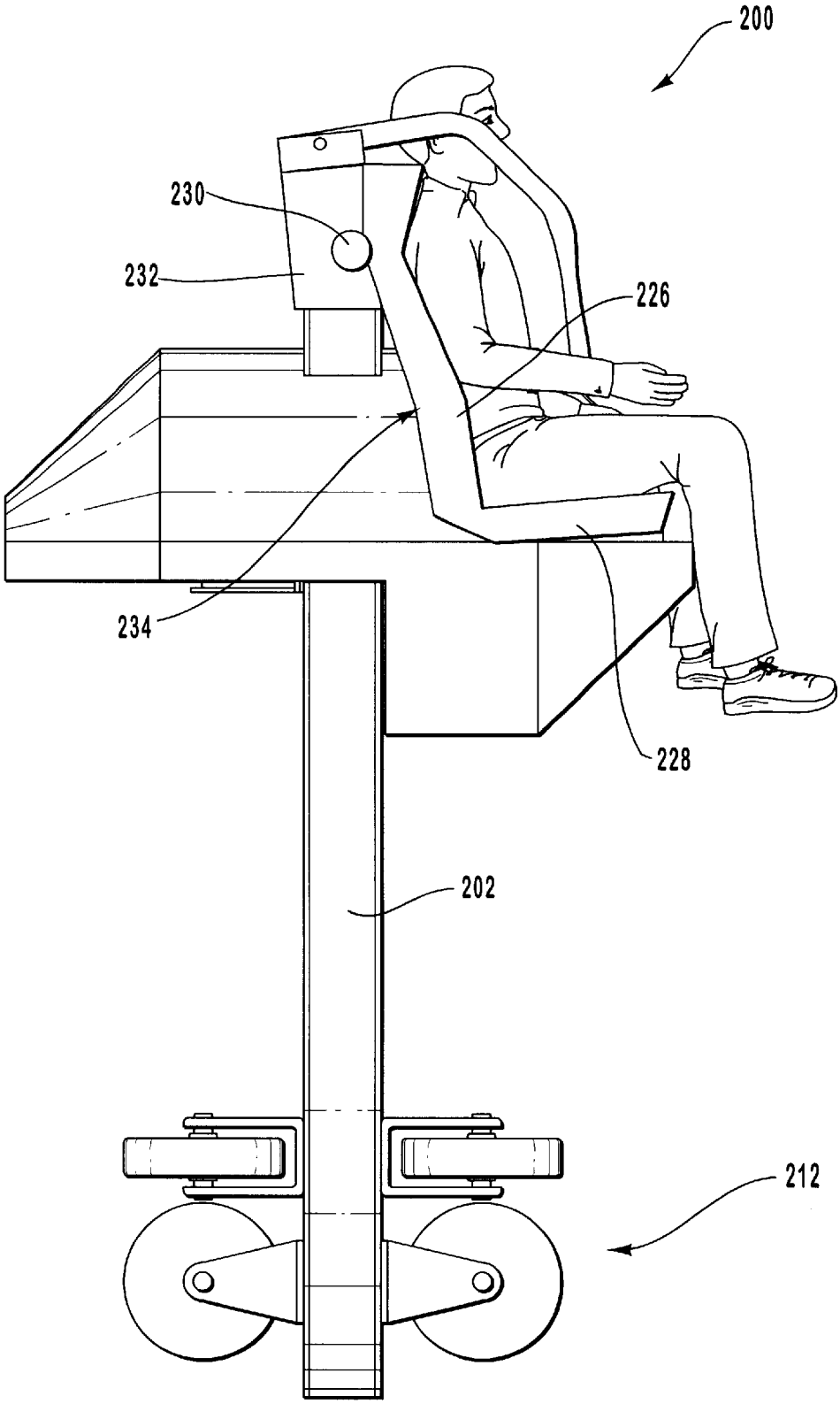
FIG. 12 is a side view of an alternative embodiment of the side-mount vehicle.

As shown in FIG. 12, an alternative embodiment for affixing the seats 226 to the cantilevered beam 208 is depicted. This embodiment employs a pivot arm 230, which may also serve as the cantilevered beam 208. Bearing assemblies 232 are attached to the back portion 234 of the seat 226, and provide a means for attaching the seat 226 to the pivot arm 230. Securing the seat 226 to the pivot arm 230 in this fashion enables the seat 226 to rotate about the pivot arm 230 in response to varying g-forces as the side-mount vehicle 200 progresses around the track. This allows pendulum-like, front-to-back movement of the seat 226 relative to the main chassis beam. Alternative points of attachment of the seats 226 to the pivot ann 230 are also possible and are included within the scope of the invention.

Regardless of the selected embodiment for attaching the seats 226 to the cantilevered beam 208, passengers may be subjected to high g-forces in several directions while the side-mount vehicle 200 is traversing a corner or a helix section of track. Hence, an effective restraining system must be employed to safely hold the passengers against the seats 226. With reference once again to FIG. 10, an example of a suitable restraint would be a three-point restraint system 236. The restraint system 236 comprises a padded restraining bar 238, a hinge mechanism 240 located behind the head of a passenger, and a locking device (not shown) to maintain the position of the restraining bar 238. The restraining bar 238 is spring loaded into an open position and may be rotated into its downward position by the passenger or by an operator. Such restraint systems 236 are commonly known in the art.

Figure 13:
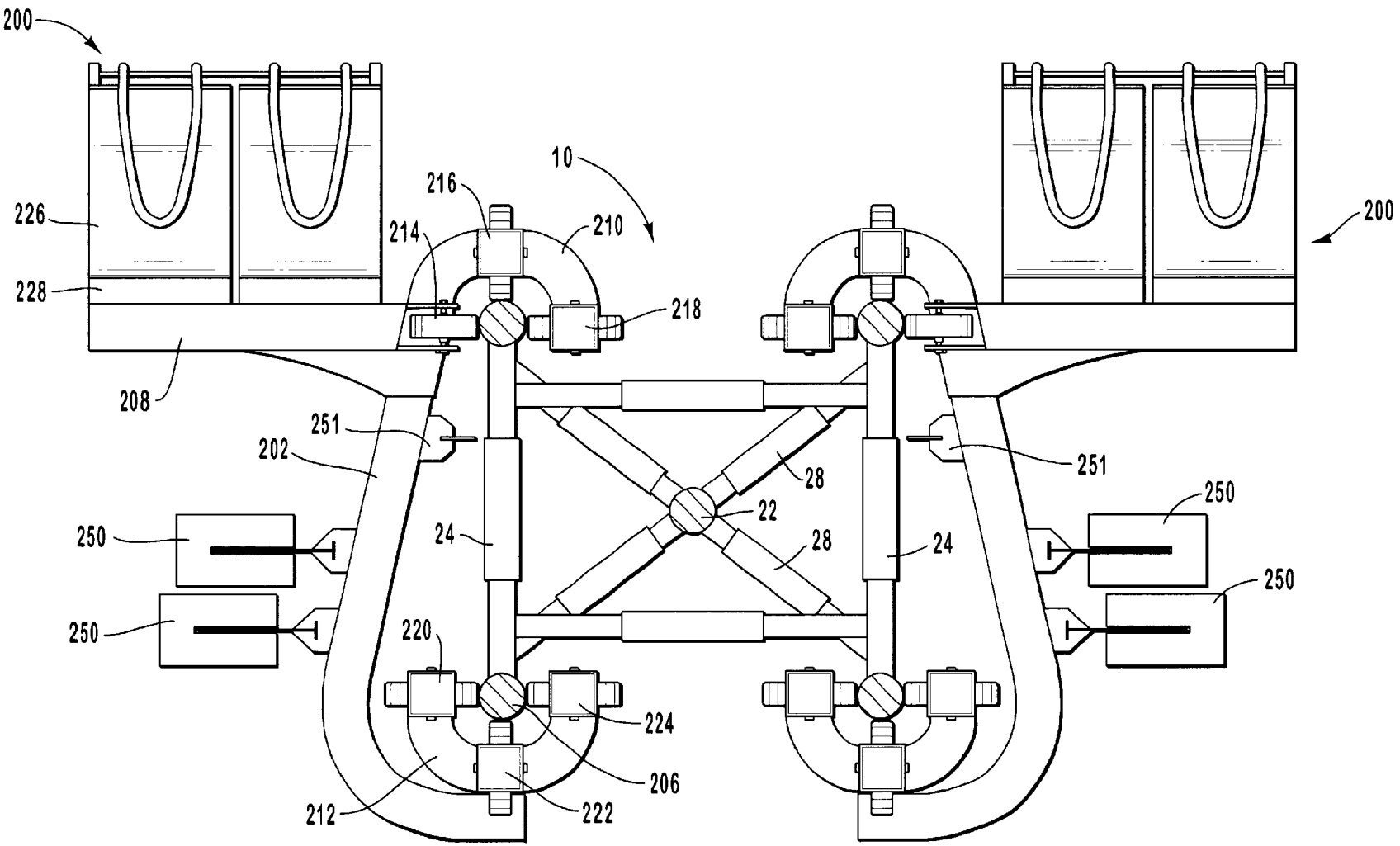
FIG. 13 is a plan view of two side-mount vehicles mounted on the dual truss track assembly FIGS. 1 and 2.

With reference to FIG. 13, two side-mount vehicles 200 are shown mounted to a dual track assembly 10. As mentioned previously, a series of linked side-mount vehicles 200 provides a roller coaster train to accommodate several passengers. Further illustrated in FIG. 13 are linear induction motors 250 to provide the propulsion to the side-mount vehicles 200. However, other conventional means of propulsion may be applied to the side-mount vehicles 200 of the invention. FIG. 13 further shows pinch brakes 251 which may be applied to the side-mount vehicles 200 to slow or stop the side-mount vehicles 200. Pinch brakes 251 and other braking means are well known in the art and may be incorporated into the roller coaster design of the present invention. Mounting two side-mount vehicles 200 allows for a racing configuration along the dual track assembly 10.

Figure 14:
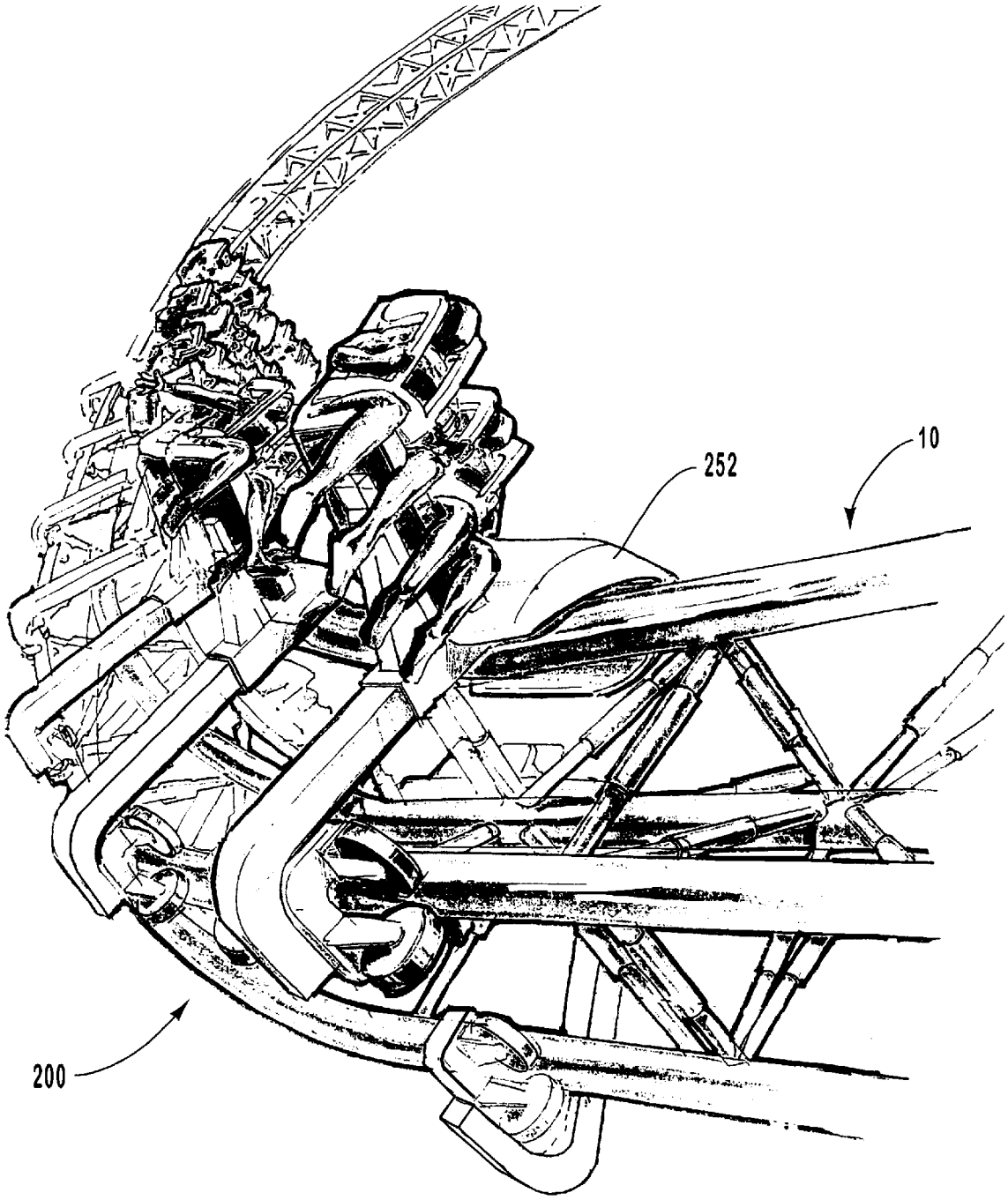
FIG. 14 is a perspective view of a train of side-mount vehicles mounted to a truss track assembly of FIGS. 1 and 2.

With reference to FIG. 14, a perspective view of a train of a side-mount vehicle 200 is shown traversing a looped section of the dual track assembly 10. The train consists of a plurality of side-mount vehicles 200 linked together in succession.

Figure 15:
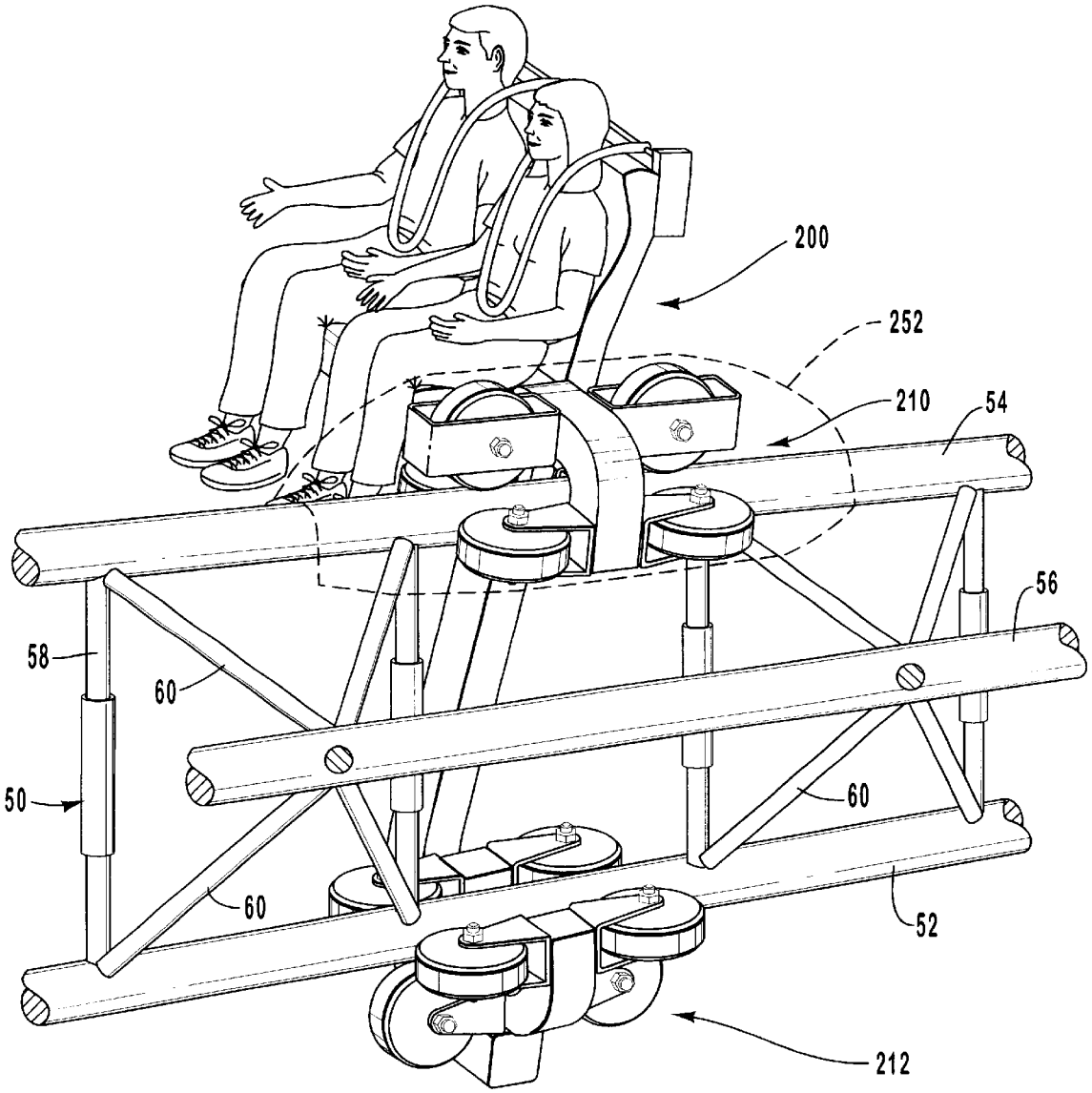
FIG. 15 is a perspective view of a side-mount vehicle mounted to a single truss track assembly of FIG. 4.

With reference to FIG. 15, a side-mount vehicle 200 is shown mounted to a single track assembly 50 of the embodiment of FIG. 4. Illustrated in FIG. 14 and in phantom in FIG. 15 are protective fender shrouds 252 which are mounted around the upper wheel assembly 210 to prevent passengers from inserting limbs into the upper wheel assembly 210. In an embodiment where the cantilevered beam 208 is mounted to a lower portion of the vertical main chassis beam 202, a protective fender shroud 252 may be required for the lower wheel assembly 212.

Figure 16:
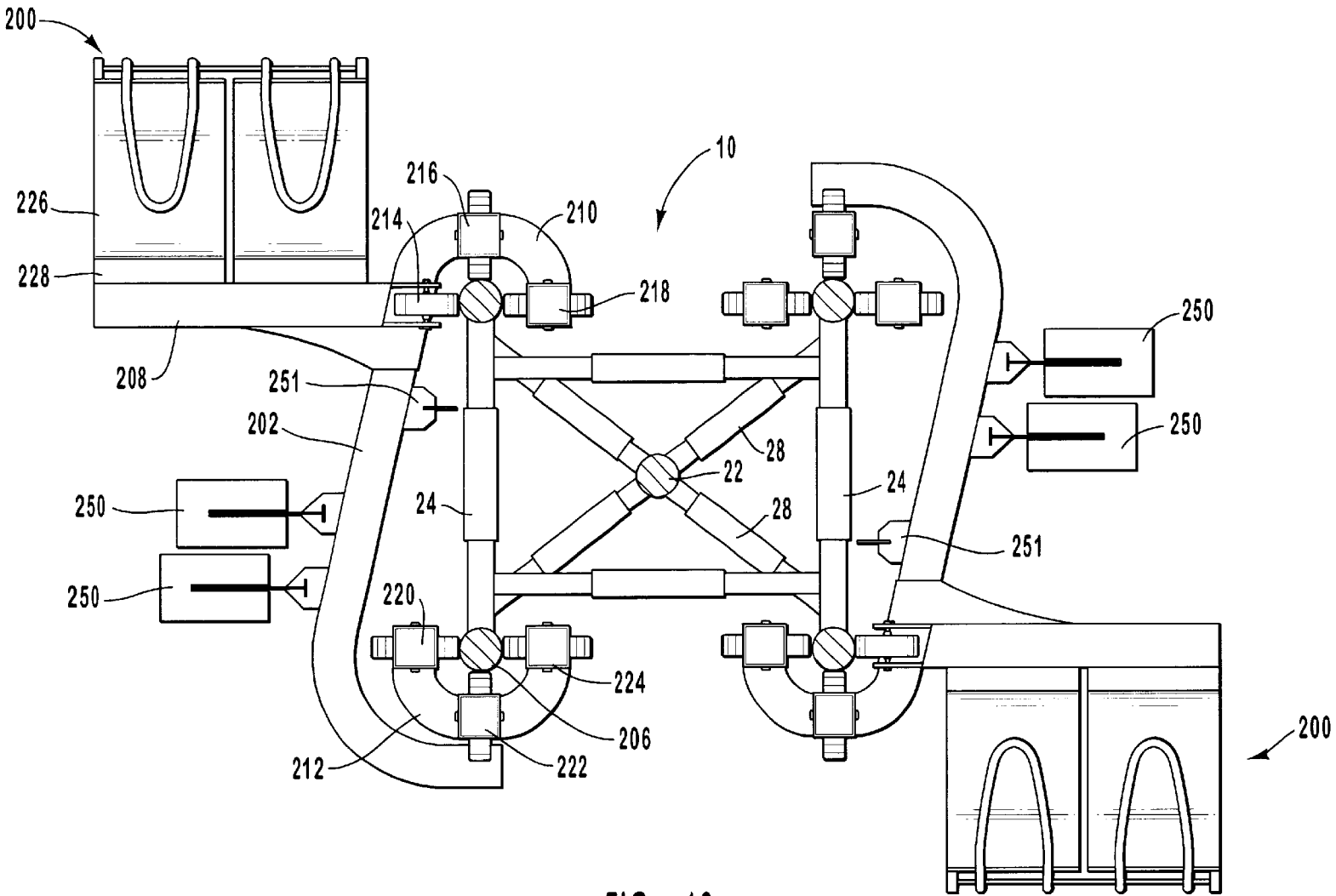
FIG. 16 is a plan view of two side-mount vehicles mounted in an alternative fashion to the dual truss track assembly of FIGS. 1 and 2.

With reference to FIG. 16 two side-mount vehicles 200 are shown mounted to the dual track assembly 10. In FIG. 16, the side-mount vehicles 200 are mounted inversely to one another such that one side-mount vehicle 200 is upside down relative to the other. This is possible in a track configuration where the dual track assembly 10 splits into two single track assemblies 50, 100. One single track assembly 50, 100 then turns upside down and then the two single track assemblies 50, 100 merge together into a dual track assembly 10. Thus, for a certain track length, one side-mount vehicle 200 is upside down relative to the other.

Thus the invention provides a track assemblies which have greater rigidity, greater track layout flexibility, lower stresses, less costly, and more fatigue proof. The track assemblies require less support structure and may therefore span greater distances. Furthermore, the unique features of the track assemblies allow for innovative designs while still allowing for conventional designs. Side-mount vehicles allow for a unique riding experience by providing substantially unrestricted passenger view in various directions, resulting in a "free flying" experience.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention.

What is claimed is:

1. A side-mount vehicle for transportation along the length of a track having substantially vertically disposed upper and lower rails, comprising:

a main chassis beam situated adjacent to the upper and lower rails, wherein the main chassis beam has an upper section adjacent to the upper rail and a lower section adjacent to the lower rail;

an upper wheel assembly secured to the upper portion of the main chassis beam and for rotatably engaging the upper rail;

a lower wheel assembly secured to the lower section of the main chassis beam and for rotatably engaging the lower rail, wherein the upper and lower wheel assemblies enable the main chassis beam to translate freely along the upper and lower rails;

a cantilevered beam secured to the main chassis beam, wherein the cantilevered beam extends away from the upper and lower rails and in a direction substantially perpendicular to a plane containing the upper and lower rails; and a seat secured to the cantilevered beam.

2. The side-mount vehicle of claim 1, wherein the upper wheel assembly comprises a plurality of spring loaded wheels, wherein the lower wheel assembly comprises a plurality of spring loaded wheels, and wherein the spring loaded wheels of the upper and lower wheel assemblies are disposed in rolling engagement with the upper and lower rails respectively.

3. The side-mount vehicle of claim 1, wherein the seat is rigidly affixed to the cantilevered beam so as to avoid movement of the seat with respect to the main chassis beam.

4. The side-mount vehicle of claim 1, wherein the seat is pivotably affixed to the cantilevered beam so as to permit pendulum-like, front-to-back movement of the seat with respect to the main chassis beam.

5. The side mounted vehicle of claim 1, wherein the upper section of the main chassis beam partially extends over the upper rail.

6. The side mounted vehicle of claim 1, wherein the lower section of the main chassis beam partially extends around the lower rail.

7. The side mounted vehicle of claim 1, wherein the seat further comprises a restraint system to secure a passenger's body to the seat.

8. The side mounted vehicle of claim 1, wherein the seat allows a seated passenger's legs to remain freely suspended.

9. The side mounted vehicle of claim 1, wherein the cantilevered beam is secured to the upper portion of the main chassis beam.

10. The side mounted vehicle of claim 1, wherein the seat comprises a bottom portion and the cantilevered beam is secured to the bottom portion of the seat.

11. The side mounted vehicle of claim 1, further comprising a protective shroud mounted over the upper wheel assembly.

12. A vehicle apparatus for transportation along the length of a track having first and second rails, the vehicle apparatus comprising:

a main chassis beam;

a first wheel assembly secured to the main chassis beam to rotatably engage the first rail;

a second wheel assembly secured to the main chassis beam to rotatably engage the second, wherein the first and second wheel assemblies enable the main chassis beam to translate freely along the first and second rails;

a cantilevered beam secured to the main chassis beam and extending from the main chassis beam; and a seat attached to the cantilevered beam so as to position one side of a passenger's body in closer proximity to the main chassis beam than the other side of the passenger's body.

13. The vehicle apparatus of claim 12, wherein the seat allows a seated passenger's legs to suspend freely.

14. The vehicle apparatus of claim 12, wherein the seat is rigidly affixed to the cantilevered beam so as to avoid any pendulum-like movement of the seat with respect to the main chassis beam.

15. The vehicle apparatus of claim 12, wherein the seat is pivotably affixed to the cantilevered beam so as to permit pendulum-like movement of the seat with respect to the main chassis beam.

16. The vehicle apparatus of claim 12, wherein the seat further comprises a restraint system to secure a passenger's body to the seat.

17. The vehicle apparatus of claim 12 further comprising a protective shroud mounted around the upper wheel assembly.

* * * * *